US005906015A

United States Patent [19]

Hilger et al.

[11] Patent Number: 5,906,015

[45] Date of Patent: May 25, 1999

[54] WALL-MOUNTED INFANT CHANGING STATION

[75] Inventors: Jeff H. Hilger, Stillwater, Minn.; Mark A. Betker, Castle Rock, Colo.

[73] Assignee: Koala Corporation, Denver, Colo.

[21] Appl. No.: 08/910,983

[22] Filed: Aug. 7, 1997

[51] Int. Cl.[6] ..... A47C 17/38

[52] U.S. Cl. ..... 5/136; 5/133; 5/603; 5/655; 5/947

[58] Field of Search ..... 5/133, 136, 603, 5/655, 947; 211/189; 312/348.1; 108/42, 157, 77

[56] References Cited

U.S. PATENT DOCUMENTS

| | | | |
|---|---|---|---|
| D. 143,290 | 12/1945 | Elson | D33/14 |
| D. 174,785 | 5/1955 | Tompkins, Jr. | D33/3 |
| D. 229,457 | 12/1973 | Mathiseson | D6/1 |
| D. 241,287 | 9/1976 | Earle et al. | D6/99 |
| D. 302,088 | 7/1989 | Burt | D6/555 |
| D. 314,112 | 1/1991 | Dainty | D6/555 |
| D. 326,384 | 5/1992 | Burt et al. | D6/555 |
| D. 327,786 | 7/1992 | Ferrell | D6/397 |
| D. 332,197 | 1/1993 | Chase | D6/555 |
| D. 367,771 | 3/1996 | Julian | D6/333 |
| D. 378,966 | 4/1997 | Helmsderfer | D6/555 |
| 2,128,168 | 8/1938 | Schulz | 5/94 |
| 3,644,947 | 2/1972 | Padera | 5/92 |
| 3,656,193 | 4/1972 | Schneider et al. | 5/92 |
| 3,721,434 | 3/1973 | Spies | 269/328 |
| 4,216,951 | 8/1980 | Griffin | 269/328 |
| 4,466,146 | 8/1984 | Regan | 5/98 B |
| 4,522,381 | 6/1985 | Ludwick | 269/328 |
| 4,566,130 | 1/1986 | Coates | 383/15 |
| 4,573,608 | 3/1986 | Hansen | 221/92 |
| 4,613,996 | 9/1986 | Chase et al. | 5/2 R |
| 4,723,493 | 2/1988 | Siani et al. | 108/134 |
| 4,796,314 | 1/1989 | Garduno | 5/98 A |
| 4,874,340 | 10/1989 | Smallwood | 446/28 |
| 4,876,970 | 10/1989 | Bolduc | 108/55 |
| 4,895,742 | 1/1990 | Schaub et al. | 428/35.5 |
| 4,935,973 | 6/1990 | Behrman | 5/2 R |
| 5,081,724 | 1/1992 | Takahashi et al. | 5/136 |
| 5,086,527 | 2/1992 | Takahashi et al. | 5/136 |
| 5,297,305 | 3/1994 | Williams | 5/655 |
| 5,299,336 | 4/1994 | Marteeny | 5/655 |
| 5,339,470 | 8/1994 | Shamie | 5/98.1 |
| 5,345,880 | 9/1994 | Shamie | 108/63 |
| 5,459,877 | 10/1995 | Roberti | 2/104 |
| 5,491,850 | 2/1996 | Kiester | 4/572.1 |
| 5,546,620 | 8/1996 | Matthews | 5/655 |
| 5,588,159 | 12/1996 | Poulson et al. | 4/572.1 |
| 5,709,155 | 1/1998 | Terracciano | 108/42 |
| 5,754,999 | 5/1998 | Helmsderfer | 5/136 |

OTHER PUBLICATIONS

"Diaper Deck" product brochure, American Infant Care Products, Inc., Excelsior, Minnesota.

"Small Comforts" product brochure, Four D, Inc., Apple Valley, Minnesota.

*Primary Examiner*—Brian K. Green
*Assistant Examiner*—Fredrick Conley
*Attorney, Agent, or Firm*—Sheridan Ross P.C.

[57] ABSTRACT

A wall-mounted infant changing apparatus configured to provide a relatively uniform surface in an open position for cleaning of the apparatus. The infant changing apparatus includes a support frame, a bed, a hinge means and a drive cylinder. The bed is pivotably attached to the support frame by the hinge means. The drive cylinder is also attached to the support frame and the bed to provide controlled movement of the bed from a closed position to the open position. A retaining end of the support frame and a pivot end of the bed are configured for mating interaction such that in the open position, the hinge means and the drive cylinder are shielded from waste material.

17 Claims, 5 Drawing Sheets

22
62
8
6
40
24
34
20
52
6
8
26
32
54

22
40
30
34
64
36
20
24
60
36
58
50
62
32
48
56

34
20
22
74
72
76
86
114
130
32
74
112
78
26
86
120
82
110
118
80
98
90
102
70
51
48
134
130
132
112
100
96
120
116
94
92
102
104
24
116
54
98
100
56
52
48

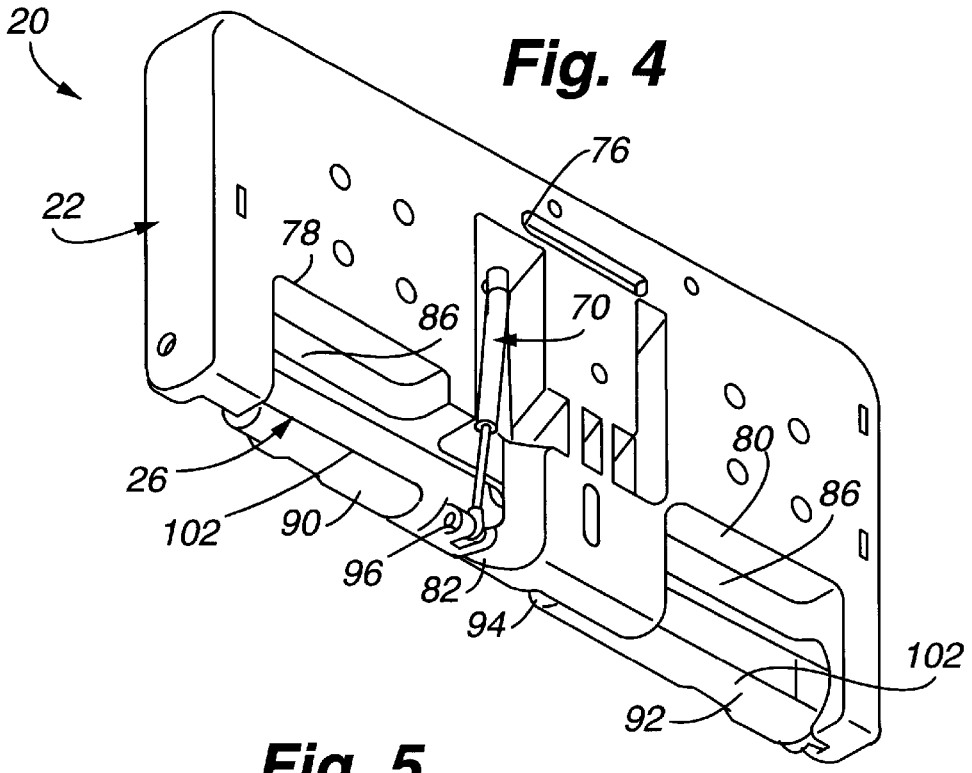
Fig. 4
Fig. 5
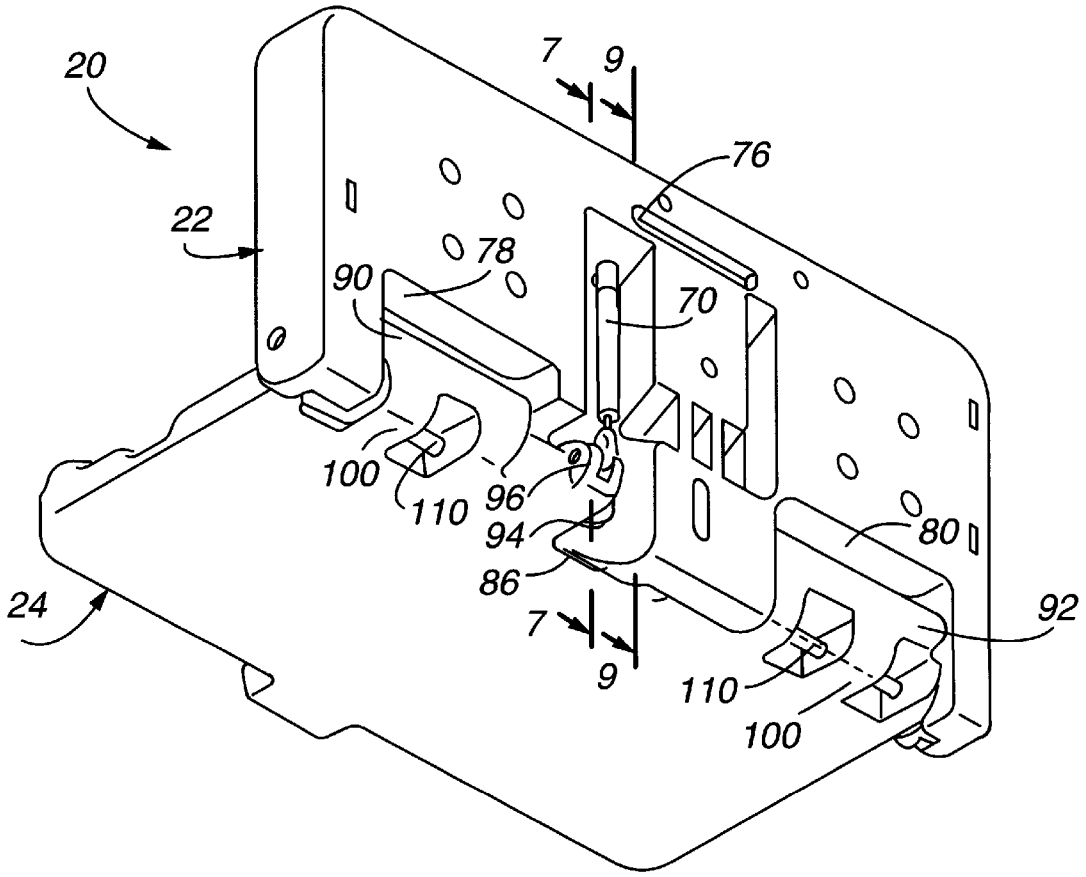

WALL-MOUNTED INFANT CHANGING STATION

BACKGROUND OF THE INVENTION

The present invention relates to an infant changing station. More particularly, it relates to a wall-mounted infant changing apparatus having a bed pivotably attached to a frame such that in an open position, a uniform surface is presented for easy cleaning.

Parents of babies and infants not yet toilet trained often face a dilemma when visiting a public establishment, such as a restaurant, retail store, health club, etc. Namely, the child will soil his or her diaper, and require changing. Unfortunately, many rest rooms are not designed to facilitate easy changing of the infant's diaper. Changing of a diaper normally requires a flat surface on which to lay the baby or infant, removing the diaper, cleaning the child and placing a new diaper on the child. In a standard public rest room which does not include a stand alone changing table, the parent is forced to hold the baby upright with one hand while changing with the remaining hand. When designing a new rest rooms this problem can be addressed by including a permanent changing table in the rest rooms. However, for an existing rest room, constructing a stand-alone changing table likely is cost prohibitive. Further, space restrictions may render a permanent changing station impossible.

The above problem has been addressed with the advent of wall-mounted infant changing stations. As suggested by its titles the wall-mounted changing station is attached to a wall in the facility's rest room. To this end, a standard wall-mounted infant changing station includes a frame to which a bed is pivotably attached. More particularly, the standard wall-mounted changing station further includes a hinge means attaching the bed to the frame in conjunction with a support system. When not in use, the bed folds tightly against the frames thereby limiting space requirements. To use the station, the user simply pivots the bed away from the frame, providing a flat table for changing diapers. The support system supports and maintains the bed relative to the frame in the open position.

Wall-mounted infant changing stations have gained rapid acceptance over the past several years. As the demand for the stations has increased, various improvements to the standard design have been made. For example, a safety strap can be added to the bed to assist in holding the baby during the changing process Additionally, a pneumatic cylinders be incorporated to control the pivoting action of the bed away from the support frame. Finally, other accessories, such as diaper dispensers, towel dispensers, etc., have also been utilized.

While the above "improvements" have undoubtedly increased the wall-mounted changing station's marketability, other problems still remain. Cleanliness of the infant changing station is of obvious importance. Parents are unwilling to place their baby or infant on the changing table or bed if the bed is in any way unsanitary. As the changing station is specifically intended for changing soiled diapers, the opportunity for unintentional contamination or dirtying of the changing station is quite prevalent. Because the waste material placed on the infant changing station has a distinct odor and unhygienic appearance, it is extremely important that the infant changing station be thoroughly cleansed after each use. While a restroom operator can periodically clean the infant changing station, users of the station must also attempt to wipe the station after use in order to maintain a sanitary environment.

Paper towels or other cleaning supplies can be positioned near the wall-mounted infant changing station to encourage wiping the bed and frame after a use. However, the design of the standard wall-mounted infant changing station inherently prevents thorough cleaning. Namely, the means for pivotably attaching and supporting the bed to the frame is such that when in the open position, numerous slots and other recesses are exposed. As previously described, the standard wall-mounted infant changing station includes a bed hinged to a support frame. Further, the bed must be supported against the support frame in the open position. To accomplish this required relationship, the standard design includes a number of large openings at the point of attachment between the bed and the support frame. Because these openings are exposed in the open position, waste material is easily deposited in these openings. Even furthers designs incorporating a pneumatic cylinder normally expose at least a portion of the cylinder to wast material when the station is in an open position. It is extremely difficult to clean the waste material from these recesses. The user/parent who makes an effort to quickly clean the infant changing station after use is highly unlikely to take the necessary efforts to completely scrub the many recesses. Over time, as waste material continues to build within the recesses, a highly unsanitary environment is created. Therefore, the standard wall-mounted infant changing station design greatly impedes adequate cleaning of the station.

While numerous accessories and other "improvements" to the standard wall-mounted infant changing station have been devised, the above-described cleansing problem has not been addressed. Therefore, a need exists for a wall-mounted infant changing station design to present a uniform surface for simple and effective cleaning.

SUMMARY OF THE INVENTION

The present invention provides a wall-mounted infant changing apparatus configured to present a uniform cleaning surface. The wall-mounted infant changing apparatus includes a support frame, a bed, a hinge means and a drive cylinder. The bed is attached to the support frame by the hinge means and the drive cylinder. More particularly, the drive cylinder provides controlled movement of the bed relative to the support frame, such that in a first, closed position the bed is approximately parallel to the support frame and in a second, open position the bed is approximately perpendicular to the support frame.

In the preferred embodiment, the support frame is configured for attachment to a wall and includes a front face, a rear face and a retaining end. The retaining end of the rear face forms a receiving recess defined by a stop wall. The bed includes an exterior surface, a working surface for holding an infant and a pivot end for pivoting attachment to the retaining end of the support frame. In this regards the pivot end includes a stop arm sized to mate and move within the receiving recess of the support frame and contact the stop wall of the receiving recess in the open position to support the bed. The hinge means attaches the retaining end of the support frame to the pivot end of the bed and is configured such that in the open position, the hinge means is shielded by the front face of the support frame and the working surface of the bed, thus providing an unobstructed surface for cleaning. Finally, the drive cylinder is attached to the rear face of the support frame and the pivot end of the bed such that when the bed is in the open position, the drive cylinder is encompassed by the support frame and the bed.

The wall-mounted infant changing apparatus of the present invention functions similar to the standard changing station design. Namely, when not in use (or in the closed position), the bed is positioned in approximately parallel alignment with the sup port frames thus presenting a compact area. In the open position, the bed extends from the support frame in an approximately perpendicular fashion. The bed pivots from the closed position to the open position about the hinge means. Further, the drive cylinder provides controlled movement of the bed relative to the support frame. The pivot end of the bed includes the stop arm which mates within the receiving recess of the support frame. More particularly the stop arm/receiving recess configuration allows movement of the bed from the closed position to the open position. However, in the open position, the stop arm contacts or abuts the stop wall of the receiving recess, preventing further movement. Further, the area of contact between the stop arm and the stop wall supports any weight placed on the bed.

After use, the wall-mounted infant changing apparatus of the present invention is easily cleaned. In the open position, the hinge means is shielded by the front face of the support frame and the working surface of the bed. Similarly, the drive cylinder is encompassed by the front face of the support frame and the working surface of the bed. Therefore, a nearly uniform surface is presented for cleaning. There are no unnecessary grooves or other openings in which waste material may be deposited.

BRIEF DESCRIPTION OF THE DRAWINGS

FIG. 4 is a rear perspective view of the wall-mounted infant changing apparatus of the present invention in a closed position;

FIG. 5 is a rear perspective view of the wall-mounted infant changing apparatus of the present invention in an open position;

DETAILED DESCRIPTION OF THE INVENTION

A. Wall-Mounted Infant Changing Apparatus 20

Figure 2:
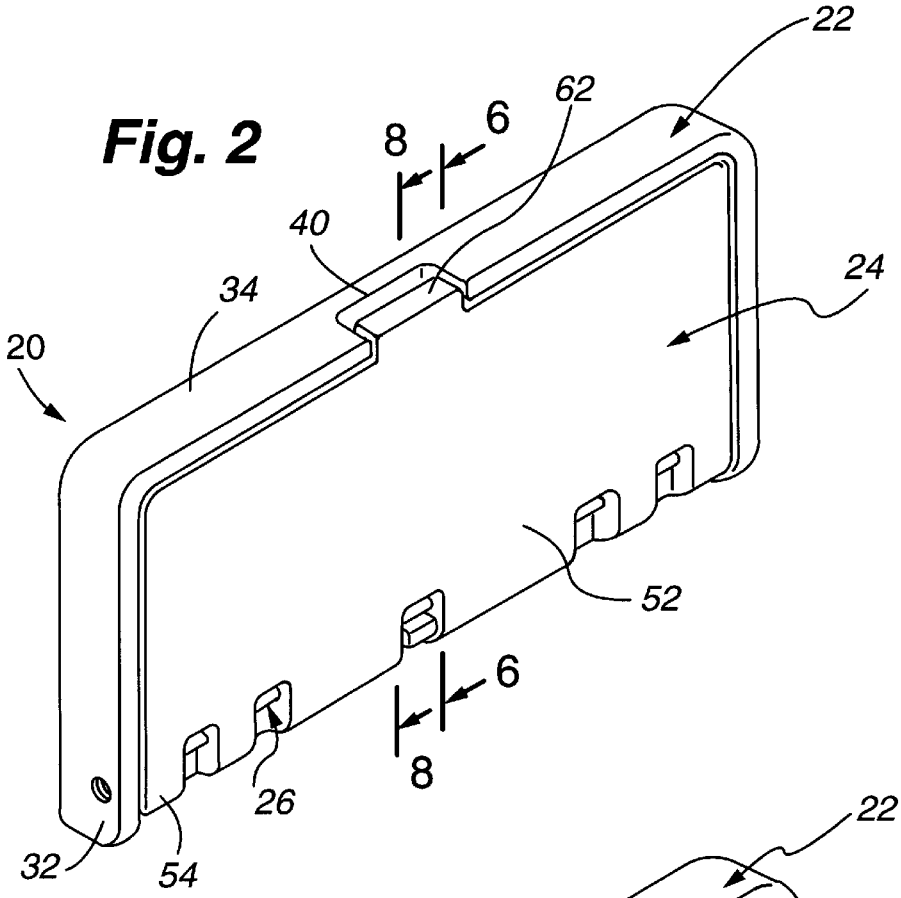
FIG. 2 is a front perspective view of the wall-mounted infant changing apparatus of FIG. 1 in a closed position.
Figure 1:
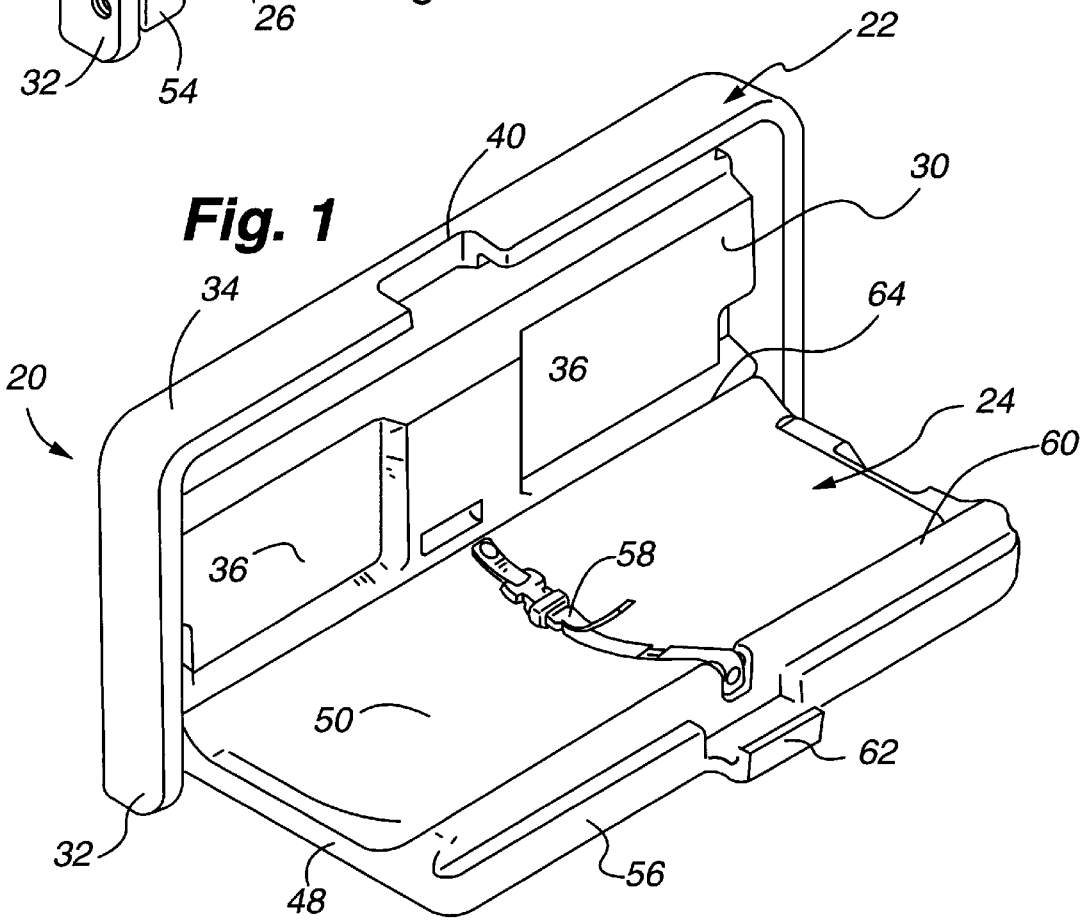
FIG. 1 is a front perspective view of a wall-mounted infant changing apparatus of the present invention in an open position.

FIGS. 1 and 2 show a preferred embodiment of a wall-mounted infant changing apparatus 20. The changing apparatus 20 includes a support frame 22, a bed 24 and a hinge means 26. The hinge means 26 pivotably connects the bed 24 to the support frame, such that the bed pivots about the hinge means 26 from an open position to a closed position.

More particularly, in the open position (FIG. 1), the bed 24 is approximately perpendicular to the support frame 22. Preferably, in the open position, the bed 24 forms a slightly acute angle with respect to the support frame 22 such that a baby or infant (not shown) placed on the bed 24 is guided toward the support frame 22 as opposed to off of the bed 24. In the closed position (FIG. 2), the bed 24 is approximately parallel with the support frame 22.

Greater details on the various components are provided below. Generally, however, the support frame 22 includes a front face 30, a retaining end 32 and an exterior wall 34. The front face 30 is preferably a flat surface, having depressions 36. The depressions 36 are provided merely for aesthetic purposes, and are not required elements. For example, the depressions 36 can be used to display product and/or company information. Importantly, the depressions 36 do not expose the hinge means 26 or otherwise create creases in which waste material (not shown) can be lodged.

The exterior wall 34 extends about a periphery of the front face 30 and includes an aperture 40. The exterior wall 34 defines a receiving area in which the bed 24 nests in the closed position. The aperture 40 is sized to receive a portion of the bed 24 in the closed position (FIG. 2).

The bed 24 includes side walls 48, a working surface 50, an exterior surface 52, a pivot end 54 and a free end 56. The working surface 50 is preferably concave to maintain a baby or infant and includes a security strap 58 and a ridge 60. The security strap 58 is used to assist in maintaining the child (not shown) on the working surface 50. Similarly, the ridge 60 is configured to prevent the child from falling over the free end 56. The security strap 58 and the ridge 60 are not required elements of the wall-mounted infant changing apparatus 20.

The pivot end 54, as described in greater detail below, is configured to interact with the retaining end 32 of the support frame 22. Generally speaking, the pivot end 54 includes various components which mesh with reciprocal components of the retaining end 32 of the support frame 22 as the bed 24 moves from the closed position to the open position.

The free end 56 includes a handle 62 sized to nest within the aperture 40 of the support frame 22. As shown in FIG. 2, the handle 62 provides a grasping surface for a user to maneuver the bed 24 from the closed position to the open position.

The bed 24 is sized to fit within the exterior wall 34 of the support frame 22. In the open position (FIG. 1), the working surface 50 of the bed 24 and the front face 30 of the support frame 22 form an approximately continuous surface, facilitating simple cleaning of the changing apparatus 20. A single seam 64 is formed between the front face 30 of the support frame 22 and the working surface 50 of the bed 24 in the open position. However, in the preferred embodiments the support frame 22 and the bed 24 are configured such that in the open position; the seam 64 is narrow and does not provide an opening or gap extending beyond the front face 30 or the working surface 50.

Figure 3:
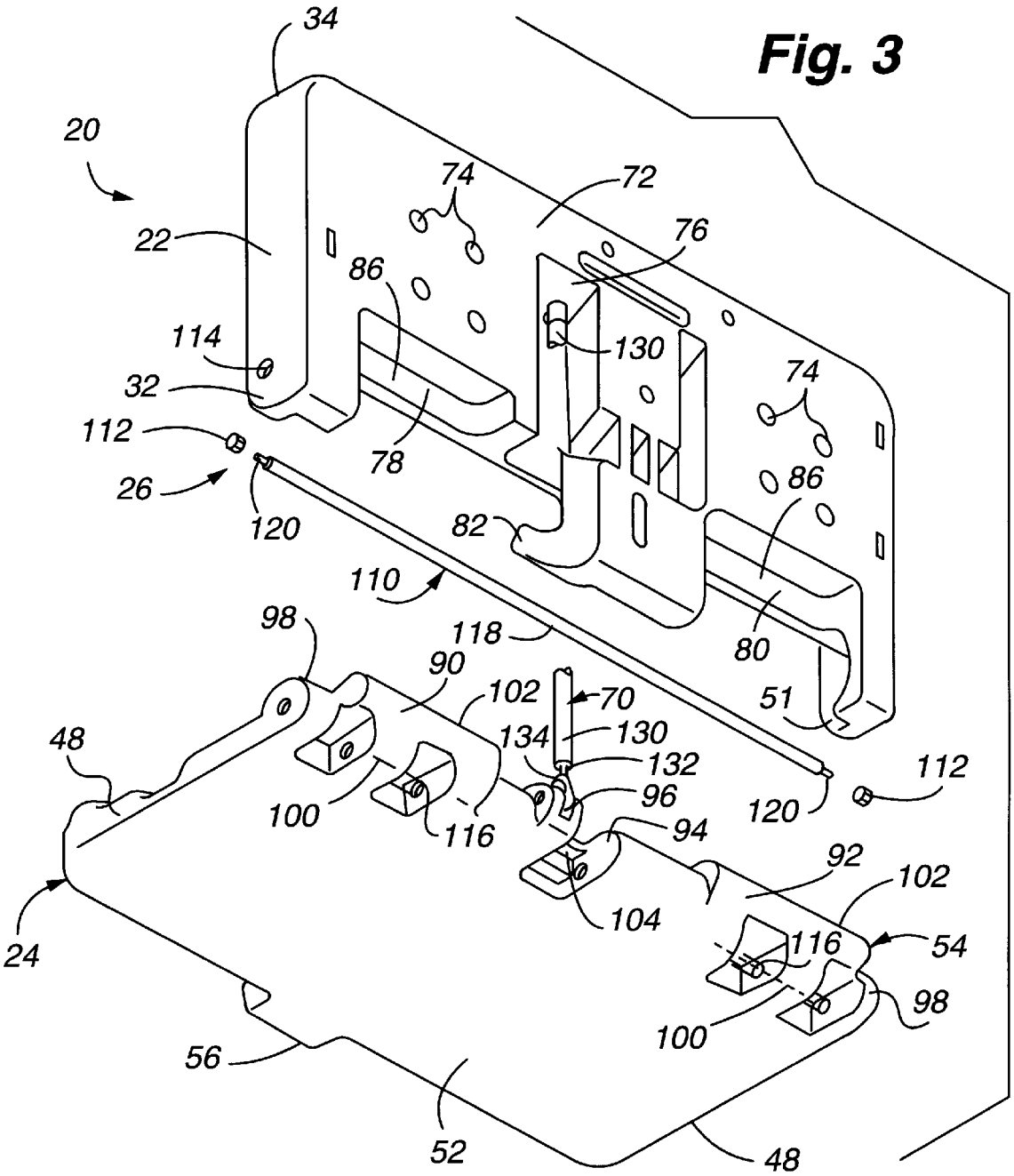
FIG. 3 is a rear, exploded view of the wall-mounted infant changing apparatus of the present invention.

FIG. 3 depicts additional details of the wall-mounted changing apparatus 20. As previously described, the infant changing apparatus 20 includes the support frame 22, the bed 24 and the hinge means 26. Additionally, the infant changing apparatus 20 includes a drive cylinder 70, shown in a partially broken form in FIG. 3. The drive cylinder 70 is attached to the support frame 22 and the bed 24 for providing controlled movement of the bed 24 relative to the support frame 22. The various components of the infant changing apparatus 20 are described in greater detail as follows.

B. Support Frame 22

The support frame 22 includes the front face 30 (FIG. 1), the retaining end 32, the exterior wall 34 and a rear face 72. The rear face 72 includes attachment bores 74 and a cylinder receiving recess 76. The retaining end 32 includes a first arm receiving recess 78, a second arm receiving recess 80, a flange 82 and shoulder grooves 84.

The rear face 72 is preferably flat for flush engagement with a wall (not shown). The attachment bores 74 are configured for securing the support frame 22 to the wall. In this regard, the attachment bores 74 are sized to slidably receive bolts otherwise attached to and extending from the wall. Importantly, the attachment bores 74 formed in the rear face 72 do not extend to the front face 30 (FIG. 1). The cylinder receiving recess 76 is sized to receive a portion of the drive cylinder 70. More particularly, the cylinder receiving recess 76 maintains the drive cylinder 70 such that an outer circumference of the drive cylinder 70 does not extend beyond the rear face 72 of the support frame 22. Similar to the attachment bores 74, the cylinder receiving recess 76 does not extend to the front face 30 (FIG. 1). Thus, the drive cylinder 70 is encompassed by the front face 30 in the open position (FIG. 1).

The first arm receiving recess 78 and the second arm receiving recess 80 are symmetrically disposed along the rear face 72 of the retaining end 32. The first arm receiving recess 78 and the second arm receiving recess 80 are preferably sized to receive a portion of the pivot end 54 of the bed 24. In this regard, the first arm receiving recess 78 and the second arm receiving recess 80 each include a stop wall 86. The stop wall 100 is preferably sized to abut a portion of the pivot end 56 of bed 24 in the open position (FIG. 1).

The shoulder grooves 84 are formed on opposite sides of the extension wall 34 at the retaining end 32. The shoulder grooves 84 are preferably rounded so as to provide a smooth contact surface for pivoting movement of the pivot end 54 of the bed 22 relative to the retaining end 32 of the support frame 22.

The support frame 22 is preferably a singular body of molded plastic, such as polyethylene. Alternatively, other strong, lightweight materials are equally acceptable.

C. Bed 24

The bed 24 includes the side walls 48, the working surface 50 (FIG. 1), the exterior surface 52 (FIG. 2), the pivot end 54 and the free end 56. The pivot end 54 includes a first stop arm 90, a second stop arm 92, a flange receiving slot 94, a piston retaining means 96, rounded edges 98 and support shoulders 100.

The first stop arm 90 and the second stop arm 92 each include a leading edge 102 (shown partially in FIG. 3). The first stop arm 90 is sized to mate within the first arm receiving recess 78 of the support frame 22. In this regard, the leading edge 102 is configured to abut the stop wall 86 of the first arm receiving recess 78 of the support frame 22 in the open position. Similarly, the second stop arm 92 is sized to mate within the second arm receiving recess 80 of the support frame 22. In this regard, the leading edge 102 is configured to abut the stop wall 86 of the second arm receiving recess 80 of the support frame 22 in the open position.

The flange receiving slot 94 is sized to mesh with the flange 82 of the support frame 22. In this regards the flange receiving slot 94 includes a limit plate 104 configured to receive a leading end of the flange 82.

The rounded edges 98 are preferably sized to nest within the shoulder grooves 84 of the retaining end 32 of the support frame 22. Finally, the support shoulders 100 are disposed near the side walls of the bed 24 and are sized to encompass a portion of the hinge means 26. Upon final assembly, the support shoulder 100 further support the bed 24 with respect to the support frame 22 via additional surface area contact with the hinge means 26.

In the preferred embodiment, the bed 24 is made as a singular body, molded from polyethylene. However, other lightweight, rigid materials are equally acceptable.

D. Hinge Means 26

The hinge means 26 includes a rod 110, retaining caps 112, opposing holes 114 in the support frame 22 and an axial passage 116 in the pivot end 54 of the bed 24. The rod 110 includes an intermediate portion 118 and threaded ends 120 sized to threadably receive the retaining caps 112. The intermediate portion 118 of the rod 110 is sized to extend along the retaining end 32 of the support frame 22. More particularly, the intermediate portion 118 is disposed with the axial passage 116 of the bed 24. The threaded ends 120 pass through the opposing holes 114 in the support frame 22. In the preferred embodiment, the rod 110 is preferably made of stainless steel and is permanently disposed within the axial passage 116 of the bed 24. Bushings (not shown) may also be included to facilitate movement of the rod 110 relative to the support frame 22.

E. Drive Cylinder 70

The drive cylinder 70, shown broken away in FIG. 3, includes a cylinder 130, a piston 132 and a retaining end 134. The drive cylinder 70 is preferably a pneumatic device, which maintains the position of the piston 132 with respect to the cylinder 130. The retaining end 134 is preferably sized for engagement with the piston retaining means 96 of the bed 24.

F. Assembly

With reference to FIG. 3, the wall-mounted infant changing apparatus 20 is constructed basically as follows. The rod 110 is preferably molded or otherwise positioned within axial passage 116 of the pivot end 54 of the bed 24 such that the threaded ends 120 extend from side walls 44 of the pivot end 54. The pivot end 54 of the bed 24 is positioned within the retaining end 32 of the support frame 22 such that the threaded ends 120 of the rod 110 extend into the opposing holes 114 of the hinge means 26. The retaining caps 112 are threadably connected to the threaded ends 120 of the rod 110 to pivotably attach the rod 110 with respect to the support frame 22. The drive cylinder 70 is disposed within the cylinder receiving recess 76 of the support frame 22. More particularly, the cylinder 130 is bolted to the rear face 72 of the support frame 22, within the cylinder receiving recess 76. The retaining end 134 of the drive cylinder 70 is connected to the piston retaining means 96 of the pivot end 54 of the bed 24 with a bolt or other acceptable attachment device.

F. Operation

Upon final assembly the infant changing apparatus 20 pivots from the closed position to the open position. As shown in more detail in FIGS. 4 and 5, in the closed position (FIG. 4), the bed 24 is approximately parallel with the support frame 22. The drive cylinder 70 exerts constant force on the pivot end 54 of the bed 24 so as to maintain the infant changing apparatus 20 in the closed position.

As shown in FIG. 5, the bed 24 pivots about the hinge means 26 to the open position. More particularly, a user (not shown) applies a pulling force on the handle 62 of the bed 24. With the "opening" or downward motion, the first stop arm 90 of the bed 24 moves within the first arm receiving recess 78 of the support frame 22. Similarly, the second stop arm 92 of the bed 24 moves within the second arm receiving recess 80 of the support frame 22. Finally, the flange receiving slot 94 of the bed 24 moves about the flange 82 of the support frame. As previously described, the various components of the pivot end 54 of the bed 24 and the retaining end 32 of support frame 22 are sized to provide relatively simple movement of the bed 24 with respect to the support frame 22 to the open position.

Notably, to facilitate movement from the closed position to the open positions spacing between the various components of the retaining end 32 of the support frame 22 and the pivot end 54 of the bed 24 is closely tolerated. In particular, in the closed position, a gap or space is defined between the leading edge 102 of the first stop arm 90 and the stop wall 86 of the first arm receiving recess 78; between the leading edge 102 of the second stop arm 92 and the stop wall 86 of the second arm receiving recess 80; and a leading end of the flange 82 and the limit plate 104 of the flange receiving slot 94. To ensure that each of these mating components contact one another in the open position, the so-defined gaps are approximately equal in the closed position. Thus, the pivoting movement of the bed 24 to the open position results in full contact between the stop arms 90, 92 and the stop walls 82, respectively; and the flange 82 and the limit plate 104.

In the open position (FIG. 5), the first stop arm 90 nests within the first arm receiving recess 78 of the support frame 22. More particularly, the leading edge 102 of the first stop arm 90 abuts the stop wall 86 of the first arm receiving recess 78. Similarly, the leading edge 102 of the second stop arm 92 abuts the stop wall 86 of the second arm receiving recess 80 of the support frame 22. Finally, the flange 82 abuts the limit plate 104 of the flange receiving slot 94 in the bed 24. In the open position, the bed 24 is fully supported with respect to the frame 22 via interaction of the first stop arm 90 with the stop wall 86 of the first arm receiving recess 78; the second stop arm 92 with the stop wall 86 of the second arm receiving recess 80; and the flange 82 with the limit plate 104 of the flange receiving slot 94. Finally, in the open position, the piston 132 is fully retracted within the cylinder 130 such that the drive cylinder 70 prevents movement of the bed 24 with respect to the support frame 22.

Figure 7:
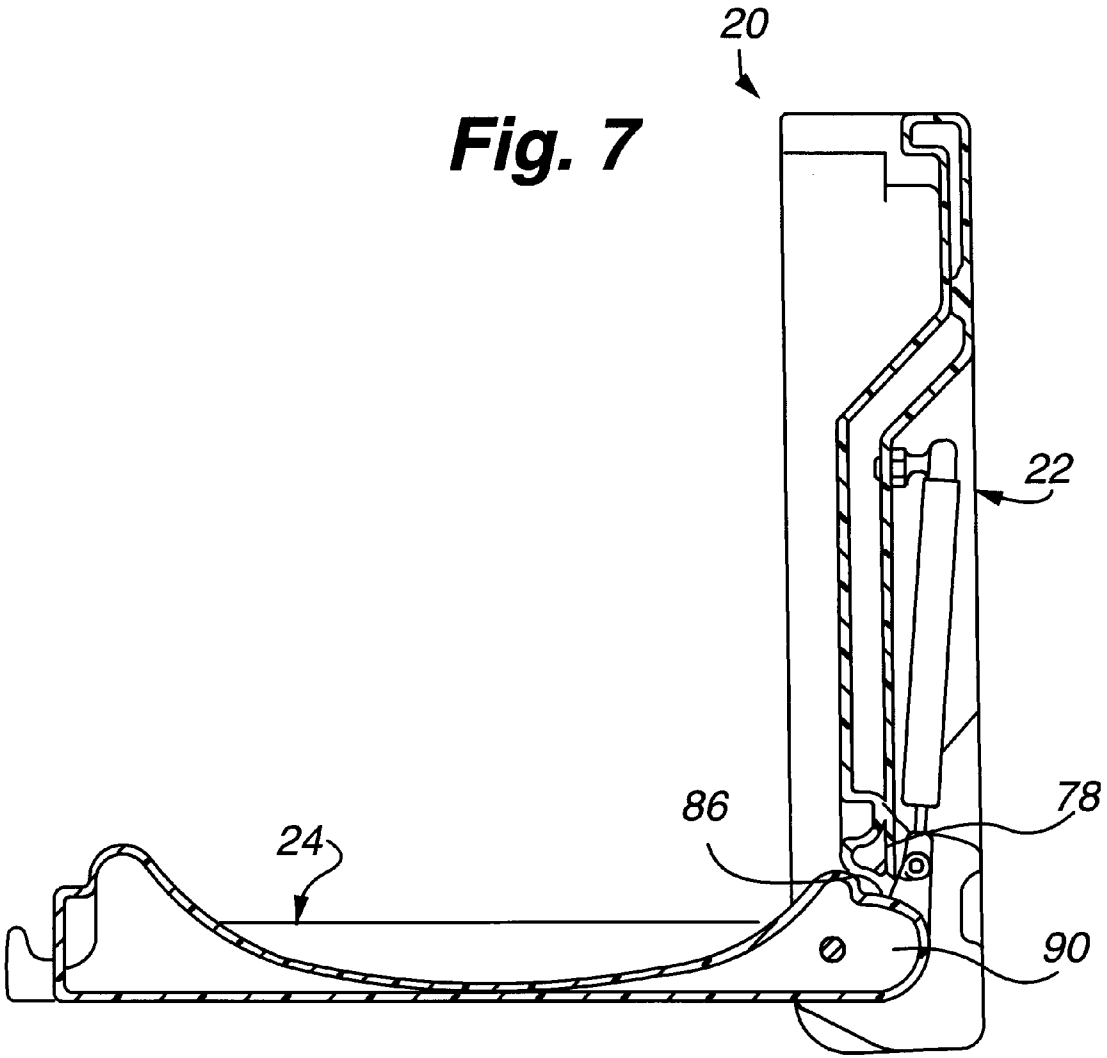
FIG. 7 is a cross-sectional view of the wall-mounted infant changing apparatus of FIG. 5 taken along the line 7—7.
Figure 6:
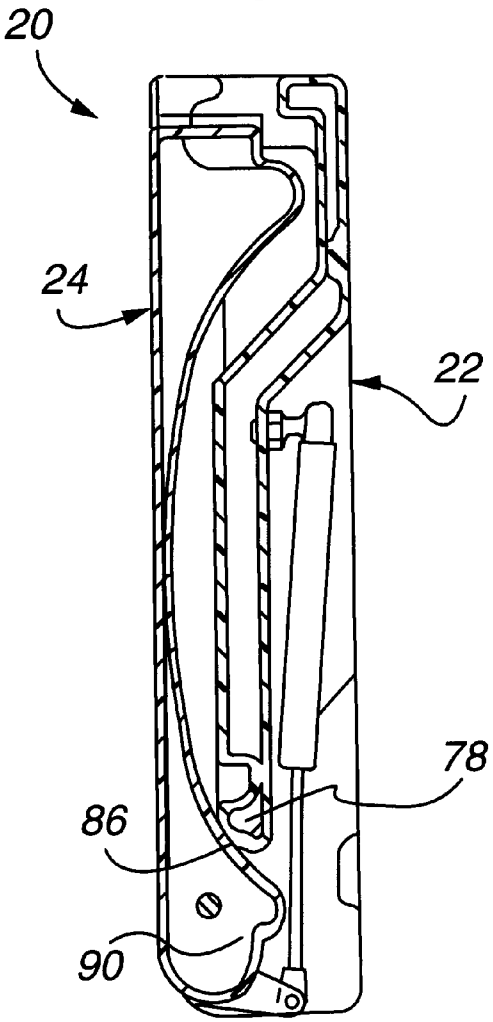
FIG. 6 is a cross-sectional view of the wall-mounted infant changing apparatus of FIG. 2 along the line 6—6.

FIGS. 6 and 7 provide further details on interaction of the first arm receiving recess 78 of the support frame 22 relative to the first stop arm 90 of the bed 24. More particularly, FIG. 6 depicts the wall-mounted infant changing apparatus 20 in the closed position; FIG. 7 depicts the open position.

In the closed position (FIG. 6) the bed 24 is approximately parallel with the support frame 22. The pivot end 54 of the bed 24 includes the first stop arm 90. The retaining end 32 of the support frame 22 includes the first arm receiving recess 78 and the stop wall 100. The bed 24 pivots with respect to the support frame 22 about the rod 110.

In the open position (FIG. 7), the bed 24 is approximately perpendicular to the support frame 22. The leading edge 102 of the first stop arm 90 abuts the stop wall 86 of the first arm receiving recess 78. Notably, the first stop arm 90 interacts with the first arm receiving recess 78 and stop wall 86 such that the bed 24 moves freely from the closed position to the open position and vice-versa. However, in the first stop arm 90 and the first arm receiving recess 78 combine to prevent further "downward" movement of the bed 24 from the open position.

Figure 9:
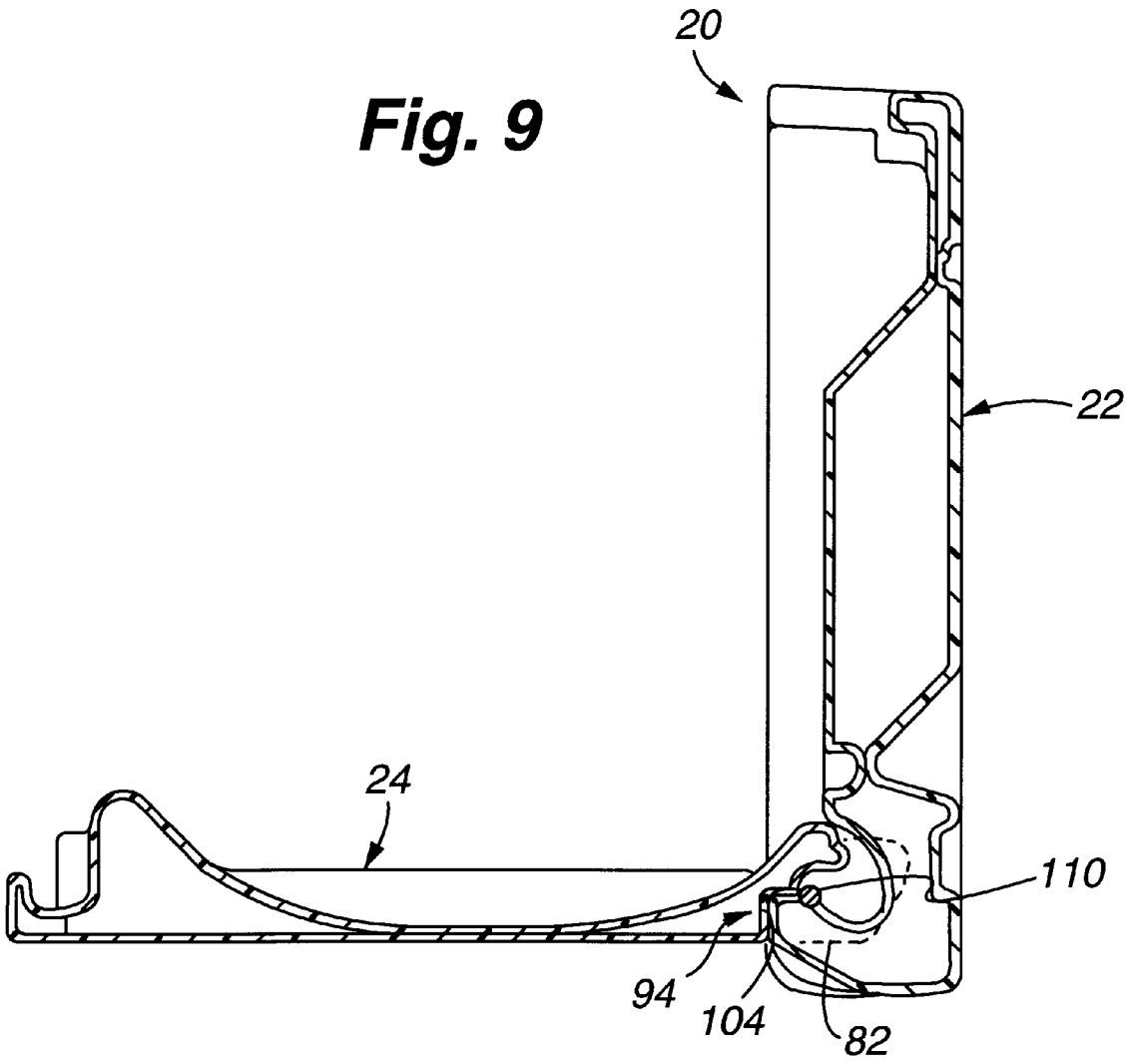
FIG. 9 is a cross-sectional view of the wall-mounted infant changing apparatus of FIG. 5 taken along the line 9—9.
Figure 8:
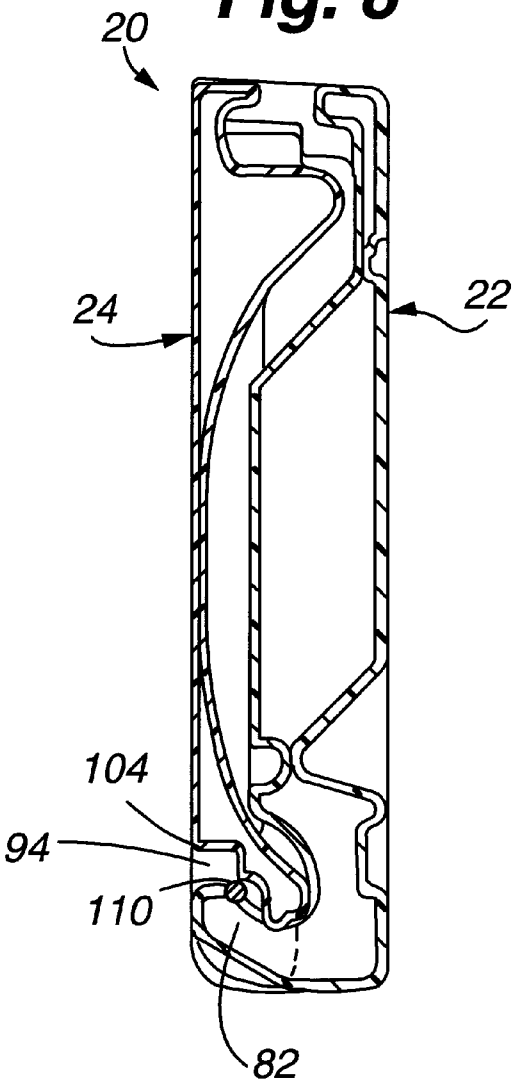
FIG. 8 is a cross-sectional view of the wall-mounted infant changing apparatus of FIG. 2 taken along the line 8—8.

FIGS. 8 and 9 provide further details on the relationship between the flange 82 of the support frame 22 and the flange receiving slot 94 of the bed. FIG. 8 depicts the infant changing apparatus 20 in the closed position, whereas FIG. 9 depicts the infant changing apparatus in the open position.

As shown in FIG. 8, the flange 82 of the support frame extends into the flange receiving slot 94 of the bed 22. Notably, the flange 82 is configured to pass about the rod 110. Once the bed 24 is moved to the open position (FIG. 9), the flange 82 abuts the limit plate 104 of the flange receiving slot 94. Notably, the flange 82 interacts with the flange receiving slot 94 such that the bed 24 moves freely with respect to the support frame 22 from the closed position to the open positions and vice-versa. However, in the open position, interaction between the flange 82 and the limit plate 104 of the flange receiving slot 94 prevents further "downward" movement.

The wall-mounted infant changing apparatus of the present invention overcomes the sanitary concerns raised with previous design. The changing apparatus of the present invention is uniquely configured to provide an easy to clean, nearly uniform surface in the open position. The support frame and bed are configured such that in the open positions the hinge means is shielded, while the drive cylinder is fully encompassed and thus not exposed to waste material. In the open position, a user can easily clean the wall-mounted infant changing apparatus of the present invention as no unnecessary gaps or components are exposed.

It will be understood that this disclosures in many respects, is only illustrative. Changes may be made in details, particularly in matters of shape, size, material, and arrangement of parts without exceeding the scope of the invention. Accordingly, the scope of the invention is as defined in the language of the appended claims. For example, while the hinge means has been described as including a centrally disposed rod, other approaches are acceptable. Thus, the rod can be replace by an exteriorly mounted hinge plate connecting the support frame to the bed.

What is claimed is:

1. A wall-mounted infant changing apparatus comprising:

a support frame configured for attachment to a wall, said support frame including a front face, a rear face and a retaining end, wherein the retaining end of the rear face forms a receiving recess defined by a stop wall;

a bed rotatably attached to the support frame such that the bed is positioned approximately parallel to the support frame in a closed position and positioned approximately perpendicular to the support frame in an open position, the bed including, an exterior surface;

a working surface opposite the exterior surface for holding an infant;

a pivot end for pivoting attachment to the retaining end of the support frame, the pivot end including a stop arm configured to move within the receiving recess of the support frame and abut the stop wall such that in the open position, the stop arm contacts the stop wall to limit further movement and support the bed in the open position, said retaining end of the support frame further including a flange extending from the rear face toward the front face, wherein the flange is sized to mate within a flange receiving recess formed in the pivot end of the bed, the flange receiving recess defined by a limit plate, and further wherein the flange and the flange receiving recess are sized to allow rotational movement of the bed relative to the support frame from the closed position to the open position and such that the flange abuts the limit plate in the open position to support the bed in the closed position.

2. The apparatus of claim 1, wherein the retaining end of the support frame forms a second receiving recess for receiving a second stop arm of the bed.

3. The apparatus of claim 1, wherein the support frame includes a plurality of attachment bores formed in the rear face for mounting the support frame to a wall, wherein the plurality of attachment bores do not extend to the front face.

4. The apparatus of claim 1, wherein the distance between the flange of the support frame and the limit plate of the bed in the closed position is approximately equal to the distance between the stop arm of the bed and the stop wall of the support frame in the closed position.

5. The apparatus of claim 1, wherein the rear face of the support frame forms a cylinder receiving recess for receiving a portion of the drive cylinder, wherein the cylinder receiving recess is sized such that the drive cylinder does not project beyond the rear face.

6. The apparatus of claim 5, wherein the cylinder receiving recess does not extend to the front face.

7. The apparatus of claim 1, wherein the pivot end of the bed includes a cylinder retaining recess for maintaining a portion of the drive cylinder, and further wherein the cylinder receiving recess is positioned at the rear face such that when the bed is in the open position, the drive cylinder is shielded by the front face of the support frame and the working surface of the bed.

8. The apparatus of claim 1, wherein the hinge means comprises:

a rod having opposing ends and an intermediate portion;

rod retaining passage formed in the pivot end of the bed for securing the intermediate portion of the rod to the bed; and a pair of opposing holes formed in the retaining end of the support frame for selectively maintaining one of the ends of the rod, respectively.

9. The apparatus of claim 8, wherein the pivot end of the bed is configured to encompass the intermediate portion to shield the intermediate portion of the rod when the bed is in the open position.

10. The apparatus of claim 9, wherein the bed is defined by vertical side walls, the bed further including:

a support member positioned proximate the pivot end, between the vertical side walls, wherein the support member is secured to the intermediate portion of the rod for supporting the bed with respect to the rod.

11. The apparatus of claim 10, wherein the bed includes a plurality of support members disposed proximate the pivot end, between the vertical side walls, for supporting the bed with respect to the rod.

12. The apparatus of claim 10, wherein the support member is a shoulder extending from the exterior surface of the bed, wherein the shoulder includes a passageway for maintaining the intermediate portion of the rod such that the intermediate portion of the rod is encompassed within the shoulder.

13. The apparatus of claim 12, wherein the support member further includes a plurality of staggered shoulders, wherein each of the staggered shoulders extends from the exterior surface of the bed.

14. A wall mounted baby changing apparatus comprising:

a support frame configured for attachment to a wall, the support frame having a front face, a rear face and a retaining end;

a bed movably associated with the support frame which that the bed is approximately parallel with the support frame in a closed position and approximately perpendicular to the support frame in an open position, the bed including an exterior surface, a working surface and a pivot end;

a flange extending from the rear face toward the front face, wherein the flange is sized to mate within a flange receiving recess formed in the pivot end of the bed, the flange receiving recess defined by a limit plate, and further wherein the flange and the flange receiving recess are sized to allow rotational movement of the bed relative to the support frame from the closed position to the open position and such that the flange abuts the limit plate in the open position to support the bed in the closed position;

hinge means pivotably connecting the retaining end of the support frame to the pivot end of the bed, the hinge means including, a rod connecting the retaining end of the support frame to the pivot end of the bed, wherein the rod is disposed within the retaining end and the pivot end such that the rod is shielded by the working surface and the front face when the bed is in the open position;

stop means positioned at the retaining end of the support frame and the pivot end of the bed, the stop means including, an arm;

a slot defined by side walls and a leading wall, wherein the slot receives the arm in a mating fashion for allowing selective movement of the arm such that the arm abuts the leading wall in the open position; and a drive cylinder for controlling movement of the bed with respect to the support frame, wherein the drive cylinder includes a first end attached to the rear face of the support frame and a second end attached to the pivot end of the bed such that the drive cylinder is shielded by the front face of the support frame and the pivot end of the bed in the open position.

15. The apparatus of claim 14, wherein the pivot end of the bed is configured to mate with the retaining end of the support frame such that the working surface of the bed and the front face of the support frame form a substantially continuous surface in the open position.

16. The apparatus of claim 14, wherein the stop means includes the slot formed in the rear face of the frame and the arm extending from the bed such that in the open position, the leading wall shields the arm from the front face of the support frame.

17. A wall mounted infant changing apparatus comprising:

a support frame for attachment to a wall, the support frame including, a rear face forming a cylinder receiving recess;

a front face opposite the rear face;

side walls, a portion of which extend from the front face, wherein each of the side walls includes a rod retaining opening positioned within the portion extending from the front face; and a retaining end, wherein the retaining end includes a slot defined by a stop wall;

a flange extending from the rear face toward the front face, wherein the flange is sized to mate within a flange receiving recess formed in the pivot end of the bed, the flange receiving recess defined by a limit plate, and further wherein the flange and the flange receiving recess are sized to allow rotational movement of the bed relative to the support frame from the closed position to the open position and such that the flange abuts the limit plate in the open position to support the bed in the closed position a bed including, a working surface configured to receive an infant;

an exterior surface opposite the working surface; and a pivot end coupled to the retaining end of the support frame by a rod such that the bed moves relative to the support frame from a closed position to an open position in which the bed is approximately perpendicular to the support frame, wherein the rod is attached to a passage formed in the pivot end and rotatably mounted to the retaining openings in the support frame and the pivot end of the bed, and further wherein the pivot end includes an arm sized to move within the slot and abut the stop wall of the slot in the open position.

* * * * *